United States Patent [19]

Schuster

[11] Patent Number: 4,785,991

[45] Date of Patent: Nov. 22, 1988

[54] SLEEVE-TYPE CARRIER WITH IMPROVED HANDLE

[75] Inventor: Richard L. Schuster, Monroe, La.

[73] Assignee: Manville Corporation, Denver, Colo.

[21] Appl. No.: 910,040

[22] Filed: Sep. 22, 1986

Related U.S. Application Data

[63] Continuation-in-part of Ser. No. 794,823, Nov. 1, 1985, abandoned.

[51] Int. Cl.[4] ..... B65D 5/46

[52] U.S. Cl. ..... 229/52 B; 206/141; 206/427

[58] Field of Search ..... 229/40, 52 B, 52 BC; 206/427, 434, 141

[56] References Cited

U.S. PATENT DOCUMENTS

| | | | |
|---|---|---|---|
| 2,598,051 | 5/1952 | Guyer et al. | 229/52 B |
| 2,718,301 | 9/1955 | Palmer | 229/52 B |
| 2,785,847 | 3/1957 | Forrer | 206/427 |
| 2,973,129 | 2/1961 | Stone et al. | 206/427 |
| 3,696,990 | 10/1972 | Dewhurst | 229/52 B |
| 3,750,874 | 8/1973 | Detzel et al. | 229/52 B |
| 4,405,078 | 9/1983 | Dutcher et al. | 229/52 B |
| 4,470,503 | 9/1984 | Stone | 229/52 B |
| 4,558,816 | 12/1985 | Wood | 206/427 |
| 4,681,252 | 7/1987 | Doerr et al. | 229/52 B |

FOREIGN PATENT DOCUMENTS

| | | | |
|---|---|---|---|
| 712905 | 7/1965 | Canada | 229/52 B |
| 1103372 | 2/1968 | United Kingdom | 206/141 |
| 1602857 | 11/1981 | United Kingdom | 229/52 B |

*Primary Examiner*—Stephen Marcus
*Assistant Examiner*—Gary E. Elkins
*Attorney, Agent, or Firm*—John D. Lister

[57] ABSTRACT

A sleeve-type beverage can carrier having an elongated handle opening in the top panel extending transversely of the length of the carrier. The handle opening is covered by a tab connected to the top panel of the carrier at a fold line extending along one of the elongated handle opening edges so that a user's fingers will fold down the tab. The tab also has an intermediate fold line parallel to its main fold line, enabling the tab to fold upon itself when it contacts a can while being folded down by the user. Slits extending from the ends of the handle opening into the upper portions of the side panels allow the top panel and side panels to flex sufficiently to permit the carrier to be lifted by the handle opening. Score lines in the upper portions of the side panels provide relief from lifting stresses. Additional score lines in the upper panel also provide stress relief. In another embodiment, the tab covering the handle opening is designed to fall to the interior of the package when the tab is pressed hard or to fold down about an edge when pressed gently.

23 Claims, 5 Drawing Sheets

38
44
36
14
30
34
46
16
42
32
16
10
40
28
24
22
12
20
26

44
36
14
34
46
30
32
16
42
16
32
40
16
10
28
24
22
12

SLEEVE-TYPE CARRIER WITH IMPROVED HANDLE

CROSS REFERENCE TO RELATED APPLICATION

This application is a continuation-in-part of application Ser. No. 06/794,823 filed Nov. 1, 1985, now abandoned.

FIELD OF THE INVENTION

This invention relates to a sleeve-type article carrier, and more particularly to a sleeve-type article carrier having an improved handle portion.

BACKGROUND OF THE INVENTION

A common type of article carrier often used to package twelve cans of beverage is the sleeve-type carrier. This is typically a paperboard package which completely encloses the cans inside and which has two hand openings in the top panel extending along the length of the package. The openings are located in the central part of the package and are spaced from each other to form a strap or handle portion between them. The carrier is formed from a generally rectangular production blank which is folded and glued by the blank manufacturer to form the top, bottom and side panels. It is shipped in collapsed form to the bottler who opens the semi-formed blank into its sleeve shape, inserts the cans and completes the folding and gluing operation to form the end panels.

Although this standard type of carrier is widely used, it nevertheless has certain drawbacks. The high concentration of stresses at the handle openings has resulted in the use of relatively thick paperboard. This is more expensive than the stock which would be used if it were not for the need to combat these high stress points. Further, the suitcase type of handle described above requires the thumb and fingers of the hand to hold the carrier in a manner that becomes tiring and tends to cut into the user's hand. For these reasons it would be desirable to have a stronger, more convenient handle design for lifting a sleeve-type carrier which, however, does not interfere with the current practice of producing the production blank from a unitary generally rectangular sheet of paperboard.

One way of overcoming some of the problems mentioned above is to abandon the suitcase type handle in favor of a single handle opening extending transversely of the folds connecting the side panels of the carrier to the top panel. The handle opening would thus be at right angles to the direction in which the openings of the suitcase type handle extend. With this arrangement a person need merely insert his fingers into the opening and easily lift and carry the package, the arms and hands being held in a more natural attitude than when lifting and carrying a package by means of a suitcase type handle.

A handle design of this general concept is not new. For example, U.S. Pat. No. 2,718,301, issued to F. D. Palmer, discloses a beverage can package which incorporates a transversely extending opening in which the fingers of one hand may be inserted to enable a person to lift and carry the package. The handle opening, prior to being used, is covered by a flap or tab which is connected at one end to the top panel of the carrier by a scored hinge line. The opposite end of the tab is connected to the top panel only by small widely spaced connecting portions so that when a person presses his fingers against the tab, the connecting portions will break away from the top panel and the tab will fold down about the hinge line. In addition to this arrangement, the tab contains an interrupted cut line which is adapted to be broken by slight finger pressure and which extends parallel to the hinge line, dividing the tab in two. When the user pushes against the tab, it folds down about the hinge line, and the portion of the tab bounded by the free tab end and the interrupted cut line is broken off by the finger pressure exerted against it, allowing the thus shortened tab to clear the cans inside the carrier as it is folded back up against the underside of the top panel.

Although a package incorporating the Palmer handle design would be simpler to lift than one incorporating the more conventional suitcase type handle, the Palmer handle has no provision against the lifting stresses which would concentrate at the ends of the handle. The paperboard used to make the carrier would have to be relatively thick and strong to resist the lifting stresses and the carrier accordingly would be relatively expensive to produce. The Palmer arrangement would therefore not overcome all the problems delineated above.

U.S. Pat. No. 4,405,078, issued to D. P. Dutcher et al, also discloses a beverage can package which incorporates a transverse handle opening. Stress relief apertures are provided in the upper portions of the side panels near the top panel and are connected to the top panel by slits. The handle opening has a foldably connected tab which covers only a portion of the opening. This arrangement provides some measure of protection against lifting stresses due to the presence of the slits and apertures in the upper portions of the side panels, but not to the degree desired in order to use paperboard of low caliper.

Another design of a prior art transverse handle opening is shown in FIGS. 10 and 11, which depict a carrier that was developed by Manville Forest Products Corporation prior to 1981. Although carriers incorporating the design were never commercially produced, prototypes of the design were shown to potential customers without confidentiality restrictions and hence may be considered to be prior art disclosures.

As shown in FIG. 10, the carrier 100 was designed to hold twelve beverage cans. The top panel 102 of the carrier, in which the transverse opening is formed, is relatively short compared to the end panel 104 to which it is connected and, as shown in the drawing, corresponds in length to three can diameters. The handle opening is offset from the center of the panel 102 in order to be located between an outer can and an interior can, thereby allowing room for the user's fingers. The opening is bounded by transverse cut 106, cuts 108 extending from the ends of the cut 106 toward the nearest end panel 104, and fold line 110 connecting the cuts 108 and extending parallel to cut 106. The flap 112 resulting from this arrangement covers the opening until folded down about its fold line 110 by the user. In addition, cuts 114 extend from the ends of transverse cut 106 through the folds 115 connecting the top panel 102 with the side panels 116, terminating in the upper portion of the side panels. The cuts 114 form a slight angle with the cut 106 so that they have a component in the direction of the nearest end panel 104.

As shown in FIG. 11, when a person presses down on the flap 112, it bends down about the fold line 110 between the adjacent beverage cans to create the handle opening through which the fingers extend. When the carrier is lifted in this manner, the panel 102 adjacent the handle opening tends to be lifted up out of its normal plane and is permitted to do so to an extent by the slits 114. The continuation of the slits 114 into the upper portion of the side panels 116 permits the folds 115 adjacent the slits 114 to move slightly inwardly toward each other. These slight movements enable the panels to yield to the stresses created by the lifting process an amount sufficient to prevent tearing.

Although the prior development of Manville Forest Products Corporation provides for some alleviation of lifting stresses, it does so at the expense of other important considerations. Although lifting stresses are minimized by the handle opening being located near a corner of the package, the offset location is not desirable from a customer point of view since the weight of the package is not evenly distributed. It would be much preferable to be able to locate the handle opening in the center of the carrier for ease and convenience of carrying. Further, the handle design is intended for use with relatively heavy paperboard stock which because of its thickness and strength contributes to the resistance against tearing caused by lifting stresses. Such a design would not permit the use of thinner paperboard, which is one of the important objects of this invention.

Another prior art example of a beverage can carrier incorporating a transverse handle opening is disclosed in U.S. Pat. No. 4,558,816, issued to P. J. Wood. In this arrangement a transverse slit extends completely across the top panel of the carrier and down into the side panels, terminating there a short distance from the folds connecting the top panel to the side panels. Two fold lines are provided along a substantial portion of the top panel parallel to and equally spaced from the slit. The fold lines are connected by arcuate slits to form a handle opening initially covered by flaps or tabs hinged at their fold lines. In use, the user's fingers can be inserted into the handle opening from either end, the tab contacted by the underside of the fingers being folded down as the fingers move to grasp the underside of the top panel. At the same time the other tab is bent down out of the way by the outside of the fingers. The handle opening is located in the center of the relatively long top panel of the carrier so that it overlies the space between the two interior cans in the package. The width of the tabs is a function of the size of the cans and also of the distance between the handle opening and the side panel.

The side panels are further provided with short fold lines which extend from the ends of the transverse slit to the fold connecting the top panel to the side panels. It is stated in the Wood patent that lifting of the carton as shown in FIG. 3 of the patent drawing causes an inward bending of the triangular structure defined by the slit 16, the fold line 3 and the fold line 23. This would allow the top panel in the region being grasped by the user's hand to be pulled up out of the normal plane of the top panel as the carrier is lifted. Although this arrangement permits some distribution of the lifting stresses, they still tend to be concentrated more than desired adjacent the ends of the transverse slit, creating the need to follow relatively rigid design parameters and causing the top panel to be pulled up higher and more abruptly than desired.

It would be desirable to provide a carrier having a transverse handle design which would enable a reduction in the caliper of the paperboard without introducing an undesirable degree of flexibility in the carrier handle structure. It would also be desirable to provide a transverse handle opening flap arrangement which does not require the design constraints discussed above in connection with the Wood patent.

BRIEF SUMMARY OF THE INVENTION

This invention provides an improved handle design which overcomes the problems mentioned above. Slits extend from the ends of a single transverse handle opening into the upper portions of the side panels to allow the top and side panels to flex when the fingers are inserted into the handle opening and the package is lifted. Score lines in the upper portions of the side panels connect with the ends of the slits to prevent tearing and to distribute lifting stresses. Tension relief score lines in the top panel distribute the lifting stresses so that upon being lifted the top panel bows upwardly in a gentle uniform manner. In addition, a single flap hinged to one side edge of the opening is provided to cover the handle opening until the carrier is lifted. In another embodiment the flap is attached to the to panel along both its elongated edges by spaced narrow connecting portions which, as will be explained in more detail hereinafter, allow the tab to fold downwardly or be broken off, depending on conditions.

These design features can readily be implemented in the standard type of production blank from which sleeve-type carriers are produced, requiring only minor modifications to the blank forming die to provide for new slit and score lines.

Other features and aspects of the invention will be made clear, as well as the various benefits of the invention, in the more detailed description of the invention which follows.

DESCRIPTION OF THE INVENTION

Figure 1:
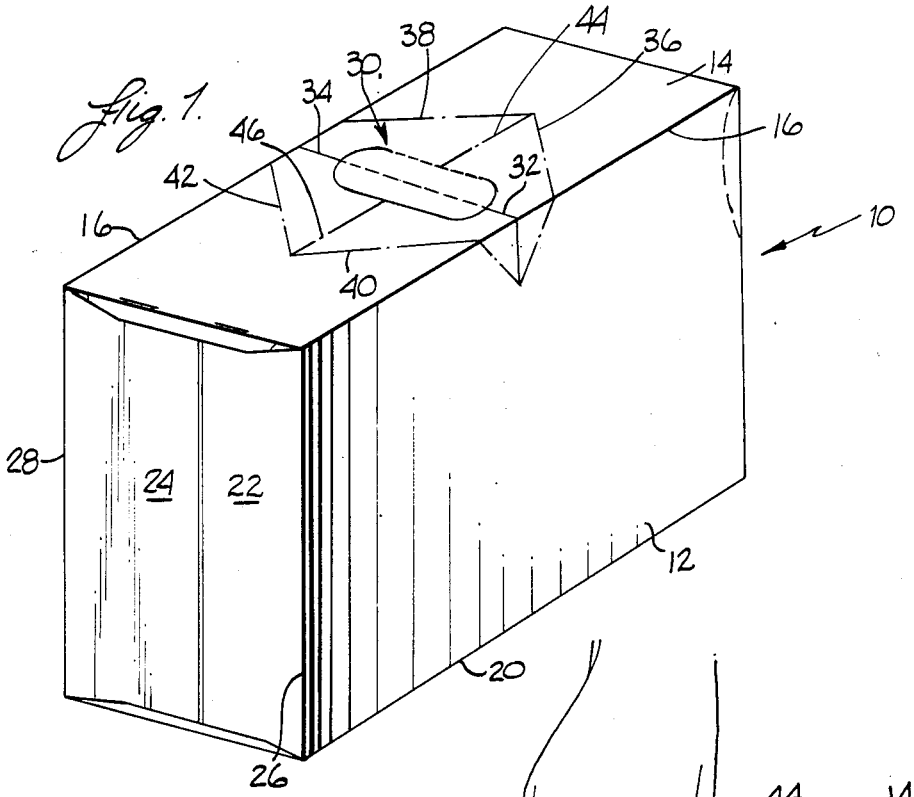
FIG. 1 is a pictorial representation of a preferred embodiment of the sleeve-type carrier of the present invention, as it would appear prior to being lifted by its handle.

Referring to FIG. 1, a sleeve-type carrier 10 comprises side panels 12 connected to top panel 14 by folds 16 and to the bottom panel (not visible) by folds 20. The end panel shown is comprised of flaps 22 and 24 which are connected to the side panels by folds 26 and 28 respectively. The flaps are attached by adhesive to other flaps foldably connected to the top and bottom panels. The latter flaps, except for portions near their fold lines, are hidden in this view by the flaps 22 and 24. A similar end panel arrangement is provided at the other end of the carrier.

Opening 30 extends transversely of folds 16 to provide a handle opening for the fingers of a person lifting the carrier. Prior to the carrier being lifted the opening 30 is covered by a flap or tab arrangement described in more detail in the discussion of FIG. 2. A slit 32 extends from one end of opening 30 through the fold 16 and down into the side panel 12, terminating in the upper portion of the side panel. Similarly, slit 34 extends in the same manner from the other end of the opening down into the upper portion of the opposite side panel. A pair of score lines 36 and 38 extend upwardly from the ends of the slits 32 and 34, crossing folds 16 and meeting in the top panel 14 between the opening 30 and the nearest end panel. In like manner, a pair of score lines 40 and 42 extend upwardly from the ends of the slits 32 and 34 across folds 16, meeting in the top panel 14 between the opening 30 and the other end panel. Additional score line 44 connects the handle opening 30 to the point at which the score lines 36 and 38 meet, and additional score line 46 connects the handle opening to the point at which the score lines 40 and 42 meet.

Figure 2:
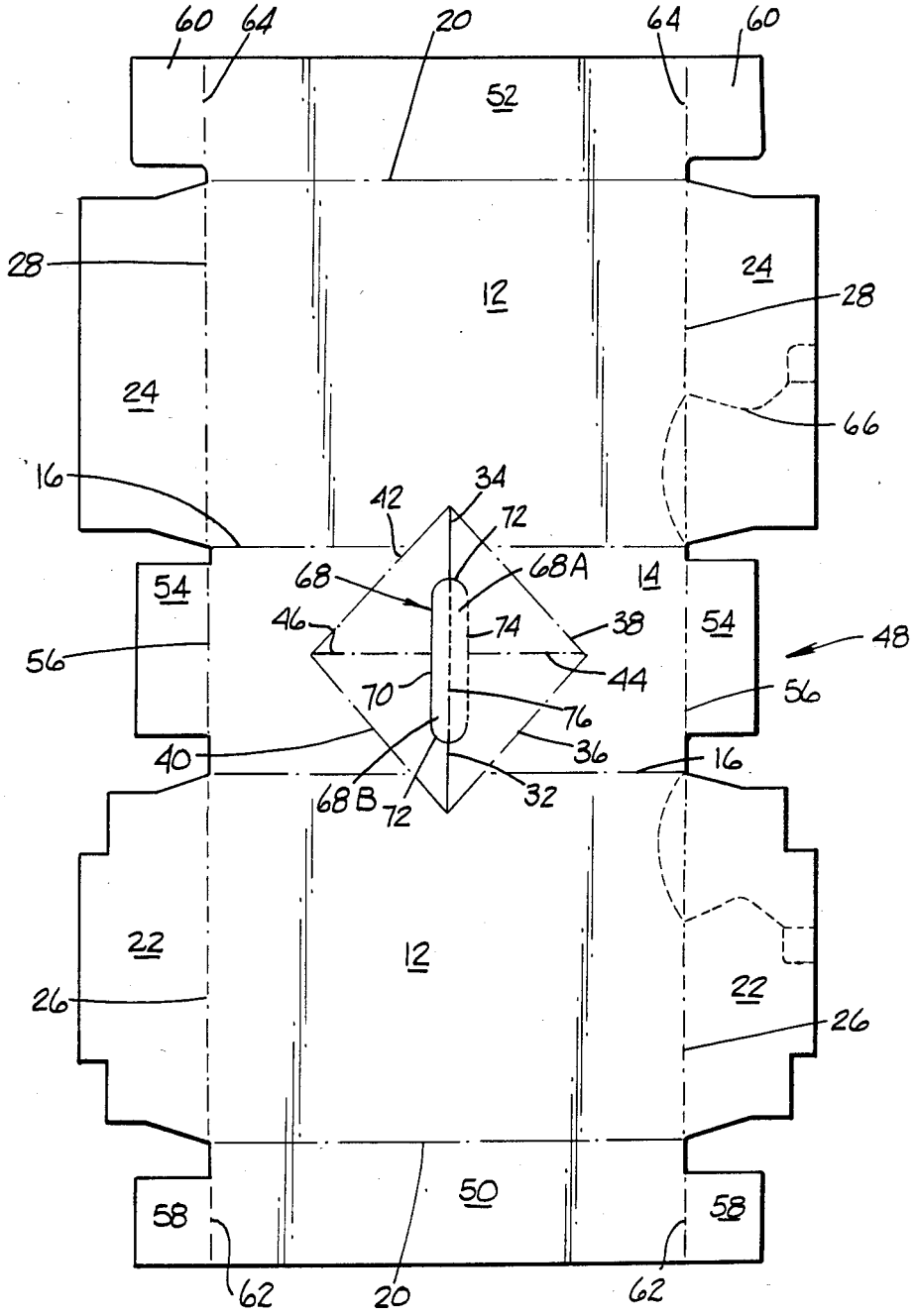
FIG. 2 is a plan view of a production blank for forming the carrier of FIG. 1.

The details of the arrangement described thus far are shown more clearly in FIG. 2 which illustrates a production blank for making the carrier of FIG. 1. The blank 48 is comprised of a central section 14 connected to intermediate sections 12 by score lines 16, the central section corresponding to top panel 14, the intermediate sections to side panels 12 and the score lines to folds 16. Connected to intermediate sections 12 by score lines 20 are end sections 50 and 52 which are dimensioned so that portions of them overlap when the blank is folded along score lines 16 and 20. The overlapping portions are glued together to form the bottom panel of the carrier 10.

Flaps 22 and 24 are connected to intermediate sections 12 by score lines 26 and 28 to enable them to be folded toward each other to form the end panels of the carrier 10. Flaps 54, connected to central section 14 by score lines 56, are adapted to be folded downwardly prior to the flaps 22 and 24 being folded so that they can act as a support against which the flaps 22 and 24 are glued. In like manner, flaps 58 and 60, connected to end sections 50 and 52 by score lines 62 and 64, are adapted to be folded upwardly prior to the flaps 22 and 24 being folded so that they too can act as a support against which the flaps 22 and 24 are glued. This arrangement is well known in the art and provides a strong construction able to hold the weight of twelve full beverage cans.

Also shown in FIG. 2 is tear line 66, which extends through portions of flaps 22 and 24 and portions of intermediate sections 12, and along score line 56 to provide a can dispenser opening when the portions of the carrier enclosed by the tear line are removed. This feature is also known in the art and does not form a part of the present invention.

As shown in FIG. 2, consistent with the arrangement described in connection with FIG. 1, the slits 32 and 34 extend from the end of the handle opening, across score lines 16 and into the upper portions of intermediate sections 12. The blank 48, however, rather than being provided with a cutout to form the handle opening 30, is provided with a tab 68 formed by slit 70, arcuate slits 72 and fold line 74, so that the fingers of a purchaser lifting the carrier will bend the tab down about fold line 74 to form the handle opening. The slits 70 and 72 may be produced by a skip-cut operation, which leaves intact narrow widely separated portions of the top panel along the slit lines. These panel portions retain the tab in position until they are torn by the tab being pressed down by the user. This arrangement is preferred from a production standpoint because it does not require removal of a cutout portion. It is also preferable from a performance standpoint because it provides a double thickness of sheet material at the handle opening, which guards against tearing and provides a cushion for the fingers at the fold 74.

As further shown in FIG. 2, the tab 68 contains a fold line 76 connecting the two arcuate slits 72, the fold line 76 being illustrated as extending down the center line of the tab in alignment with the slits 32 and 34 to divide the tab into two segments or flaps 68A and 68B. The flap 68A is thus bounded by portions of the arcuate slits 72 and the fold lines 74 and 76, while the flap 68B is bounded by the remaining portions of the arcuate slits, the fold line 76 and the slit 70.

Figure 6:
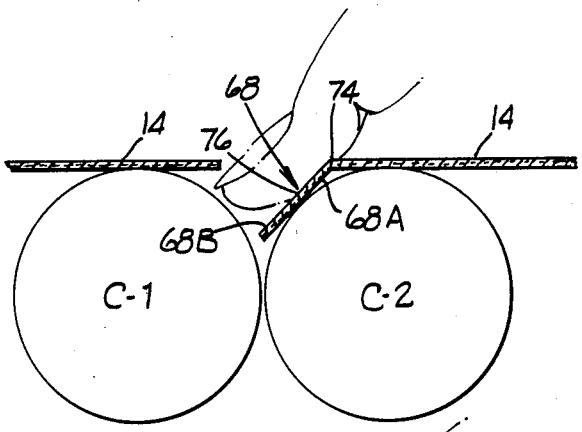
FIG. 6 is a partial sectional view taken through the handle opening, showing the handle tab after being initially pressed down by the fingers of a user.
Figure 7:
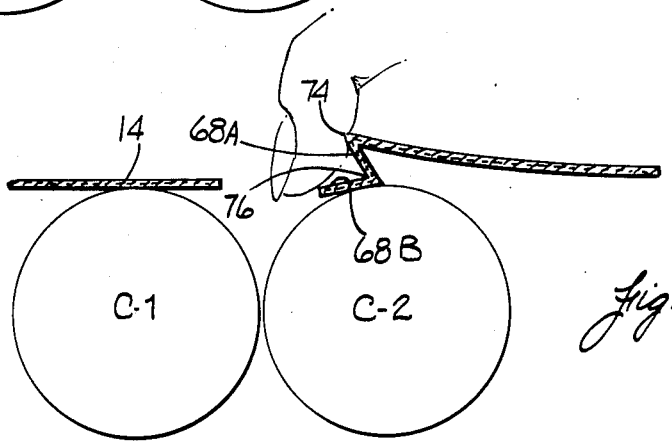
FIG. 7 is a partial sectional view similar to that of FIG. 6, but showing the two flaps of the handle tab in an intermediate stage occurring subsequent to the stage shown in FIG. 6.
Figure 8:
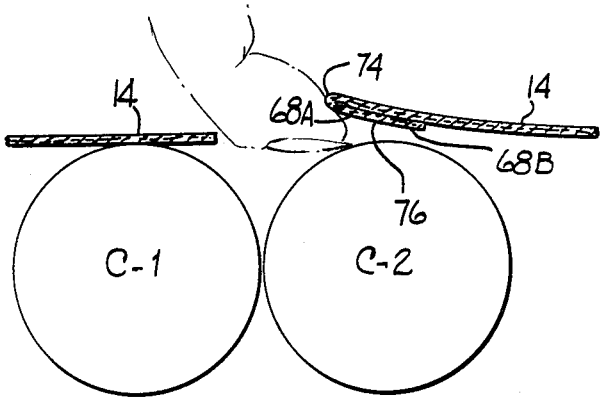
FIG. 8 is a partial sectional view similar to that of FIG. 6, but showing the handle tab in its final folded position.

The action of the tab flaps is illustrated in FIGS. 6, 7 and 8. In FIG. 6 the tab 68 is shown immediately after a user's fingers have begun to bend the tab down about fold line 74. Flap 68B is shown as having been separated from the top panel 14 along the slit 70 and moved down into the interior of the package. At this stage the flap 68B has cleared the can C1 and has met with no resistance. The fold line 76 has therefore remained stiff and intact and the flaps 68A and 68B act as a single unitary tab 68. When the flap 68B hits the can C2, however, flap 68A can no longer pivot about the fold line 74. Continued pressure of the fingers against the flap 68B causes the fingers to slide up to flap 68A, as shown in FIG. 7. The flap 68A is thereby folded back about fold line 74 while the flap 68B slides up the side of the can C2, causing the flap 68B to be folded up toward flap 68A about their interconnecting fold line 76. This action is made possible by the fact that the portion of the top panel 14 between the fold line 74 and the nearest end panel is lifted up by the lifting pressure being applied. The raised portion of the top panel 14 is shown in FIG. 7.

Continued lifting by the user raises the top panel until the flap 68B reaches the uppermost point of the can C2 and is snapped by the fingers up against the underside of the top panel to assume the position shown in FIG. 8. During this latter movement the flap 68B pivots in the reverse direction about the fold line 76 until it is once again lying in the same general plane as the flap 68A.

It can be seen that the tab arrangement of this invention is different from the tab arrangement of Palmer. In the Palmer patent the finger flap 7 is separated from the cover piece 8 along the breakage line dividing the two segments. This results in the flap that is folded up against the underside of the upper panel being quite narrow, as opposed to the wide tab of this invention which corresponds to the width of the handle opening.

The Dutcher et al carrier also has a different handle arrangement than that of this invention. In Dutcher et al the handle opening is curved on the side opposite the tab fold line and the tab itself does not extend entirely across the opening. As a result dirt and other debris can find their way into the carrier through the uncovered opening. In addition the tab itself, after being folded back up against the underside of the top panel, is not designed to cover as wide an area as the tab arrangement of the present invention.

Figure 11:
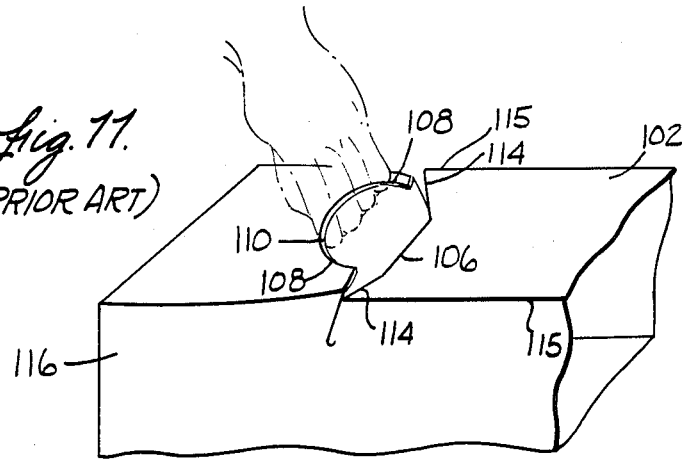
Fig. 11. (PRIOR ART)
FIG. 11 is an enlarged partial view of the prior art carrier of FIG. 10, shown as it would appear while being lifted.
Figure 10:
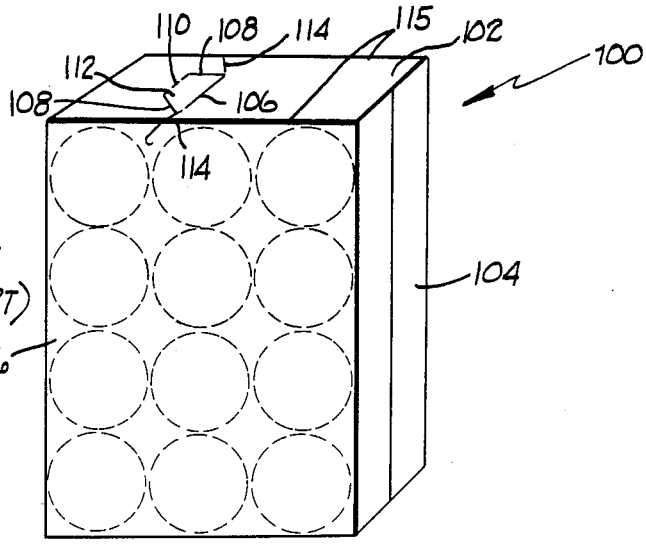
Fig. 10. (PRIOR ART)
FIG. 10 is a pictorial representation of a prior art sleeve-type carrier.

The handle arrangement of this invention is also distinct from the prior art design shown in FIGS. 10 and 11. Without a fold line in the interior of the flap, as provided in the present invention, the flap 112 of the prior art design must be made narrow enough to clear the adjacent cans in the package. Further, because a significant lifting of the top panel 102 between the handle opening and the nearest end panel is necessary in order to allow the flap 112 to clear the cans, the offset location of the handle opening was required, which is not desirable from the standpoint of carrying comfort and ease of handleadility. This feature will be discussed in more detail hereinafter in connection with the lifting of the top panel of the present invention.

The handle arrangement of this invention is also distinct from that of the carrier of the Wood patent. In column 3 of the Wood patent, beginning at line 28, it is stated that "In order to provide clearance for the carrying flap 20 to swing inwardly past the adjacent can C1, the width of handle flap 15, i.e., the distance between fold line 17 and transverse perforated slit 15 is approximately one-third of the radius of the adjacent can such as C1. This relationship of parts allows inward swinging of the flap 20 and accommodates easy clearance between that flap and the can C1."

In the present invention no such relationship need exist. As explained above the fold lines 74 and 76 of this invention allows the tab to contact the adjacent can and ride upon its side. The width of the tab can thus be greater than the width of the handle flap 15 of Wood because free inward swinging of the handle tab is not a limiting factor as in Wood.

Continuing in column 3, Wood states, beginning in line 35, that "Preferably the transverse perforated slit 15 should be disposed midway between the ends of the carrier." Since this invention does not have a perforated slit in the handle tab, this relationship does not apply. Although the fold line 76 located in the handle tab 68 is shown in the center of the tab because it is convenient during production of the carrier blank to make it aligned with the slits 32 and 34, the fold line 76 can be offset from the center of the tab if desired. The manner of bending the tab back during lifting of the carrier would be as previously described, the only difference being the point at which the tab flap 68B snaps back up against the underside of the top panel as it rides up on the can surface.

Continuing in column 37, Wood states, "Also the flap 25 may be used in order to lift and carry the carrier as well as the flap 20." In the handle arrangement of this invention there is only a single handle tab. When the carrier is lifted by inserting the fingers in the manner shown in FIGS. 6–8, the two-part tab comprised of flaps 68A and 68B folds up under the top panel and is engaged by the user's fingers. The carrier may also be lifted by inserting the fingers from the other direction, in which case the flap 68B would be separated from the top panel along the slit 70 and the fingers would lift up directly against the underside of the top panel. The flaps 68A and 68B would in this case act as a single unitary tab 68, which would simply bend down about the fold line 74 to make room for the fingers as the outside of the fingers brushed past it. The tab 68 would not in this case bend back up against the underside of the top panel.

Referring back to the drawing, as can be seen in FIG. 2 and as explained above in connection with FIG. 1, the pair of score lines 36 and 38 extend from the ends of slits 32 and 34 and meet in the central section 14 between the fold line 74 and the score line 56 shown on the right side of FIG. 2 Similarly, the pair of score lines 40 and 42 extend from the ends of slits 32 and 34 and meet in the central section 14 between the slit 70 and the score line 56 shown on the left side of FIG. 2. The purpose of the tension relief score lines 36 and 38 is to distribute the lifting stresses exerted on the carrier so that the top and side panels of the carrier do not tear. The portions of these score lines that are in the side panels distribute the lifting stresses up to the folds 16. The portions of the score lines that are in the top panel distribute lifting stresses generally uniformly into the top panel, allowing the top panel to bow upwardly without tearing when lifted by the handle opening. To make this phenomenon even more pronounced, additional score line 44 connects the handle opening with the point at which the stress relief score lines meet. To make the lifting action as uniform as possible it is preferred that the pair of score lines meet generally midway between the folds 16. While the meeting point can be closer to the end panel than the handle opening or vice versa, as desired, generally speaking the top panel will bow up more abruptly the closer the score lines are situated to the handle opening and more gently the farther the score lines are situated from the handle opening. While this location may thus vary, it has been found that the lifting stresses are distributed best when the pair of score lines meet generally centrally of the handle opening and the end panels so that they are not located too near either the handle or the end panels. Further, it is not necessary that they meet at a definite point as shown. The score lines can meet at a much less definite angle, even on a curve, and still provide the desired stress relief function.

Because the carrier can be lifted by inserting the fingers into the handle opening from either direction, a pair of score lines 40 and 42 similar to the score lines 36 and 38 are provided on the opposite side of the handle opening. Similarly, a score line 46 connecting the point of intersection of score lines 36 and 38 with the handle opening is also provided. As a result, lifting of the carrier from either end causes the bowing action described above.

The angles formed by score lines 36 and 40 with slit 32 can be of any desired degree which will result in the score line arrangement described above. Preferably, in order to have the same type and amount of distortion of the top panel regardless of which side of the handle opening is used, the angles are equal but opposite to each other. As an example, an angle of about 50° has been used with good success.

As to the slits 72 connecting the slit 70 and fold lines 74, it is preferred that they be arcuate as shown in order to prevent tearing at the finger tab area.

Figure 3:
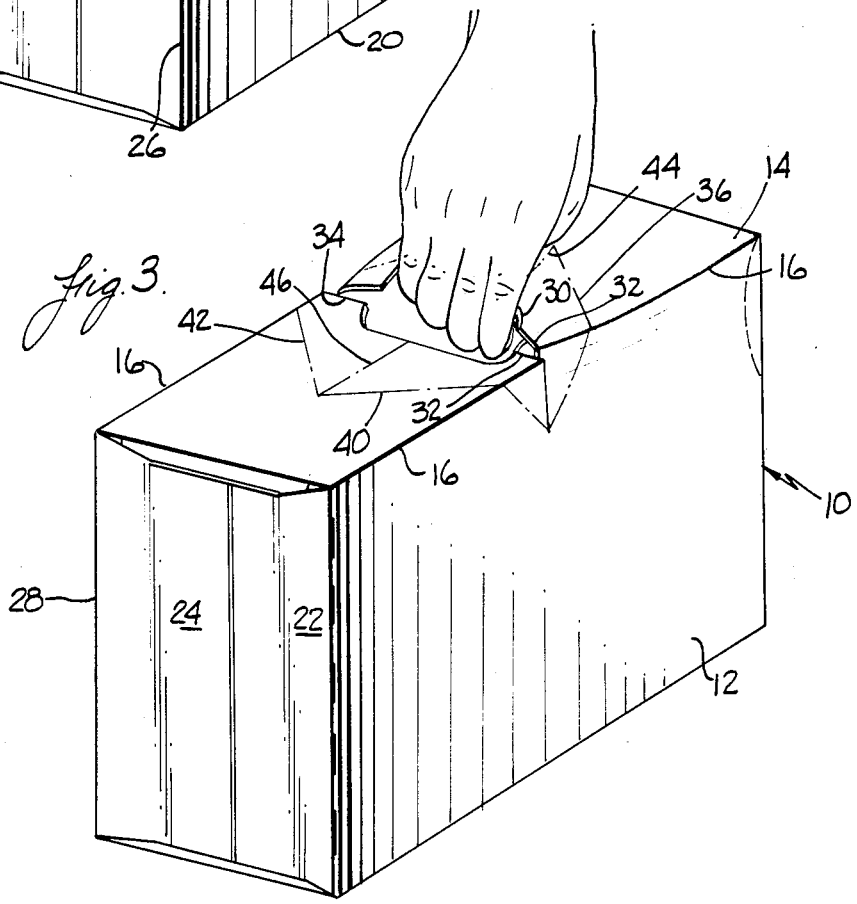
FIG. 3 is a pictorial representation of the carrier of FIG. 1, illustrating the distortions caused by the stresses produced in lifting and carrying the carrier.
Figure 4:
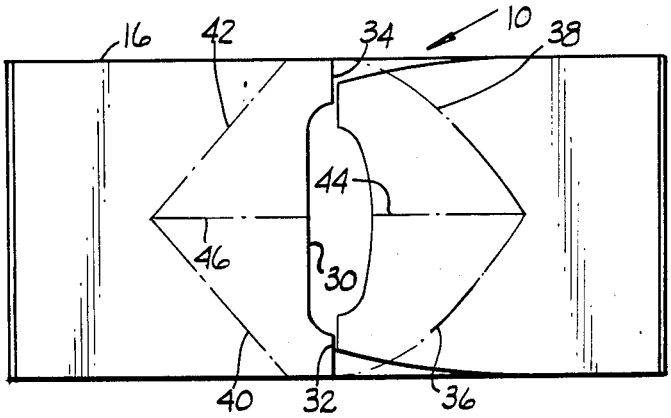
FIG. 4 is a plan view of the carrier of FIG. 3, showing from yet another perspective the distortions caused by lifting.
Figure 5:
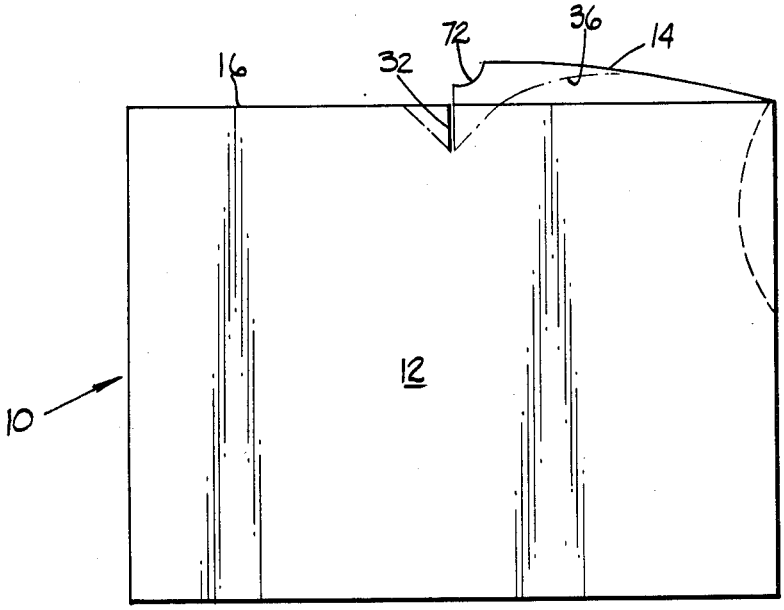
FIG. 5 is a side view of the carrier of FIG. 3, showing from yet another perspective the distortions caused by lifting.

Referring to FIG. 3, it can be seen that with the arrangement of the present invention, the carrier can be lifted by the fingers of one hand, the top panel 14 bowing upwardly as the stress relief score lines distribute the lifting stresses through the top panel and the upper portions of the side panels. As shown in FIGS. 3, 4 and 5, when the carrier is lifted the handle portion adjacent the side of the opening along which lifting stresses are being exerted is raised, the slits 32 and 34 allowing the handle opening to assume the lifting position illustrated. The stresses produced by this lifting action are effectively distributed throughout the affected areas by the score lines discussed above so that the carrier does not tear at these stress points.

The above-mentioned prior art does not disclose a lifting arrangement similar to the arrangement of this invention. For example, the Palmer patent makes no provision to provide relief slits in the sides of the carrier or stress relief score lines in the top panel, which accounts for the fact that the handle tab must be of relatively narrow width and designed to break in two so that the tab can be folded back against the underside of the top panel. Although Dutcher et al shows a relief slit in the upper portion of the side panels, no provision is made to distribute the stresses in the top panel.

The prior art carrier shown in FIGS. 10 and 11, although providing slits in the side panels, does not have stress relief score lines in the side panels or top panel. Apparently the lifting stresses were taken up to a degree by the extra rigidity afforded by lifting up on the short end of the top panel as opposed to lifting up on the long end. The offset handle arrangement permitted this relationship to exist. The present invention, however, permits the handle to be located centrally of the carrier, thereby obtaining the benefits previously discussed.

In the Wood patent, in column 2, line 34, it is stated that "According to one feature of this invention, the spacing between fold line 17 and transverse perforated slit 15, i.e., the width of handle flap 20 is equal approximately to one-half the distance between point 21 and fold line 3." This relationship is not necessary in the present invention. The distance between fold lines 74 and 76 can be greater or less than half the distance between the arcuate slit 72 and the fold line 16. The stress relief provided by the score lines in the upper panel of the carrier makes it unnecessary to adhere to a rigid design relationship such as advocated in Wood.

The Wood patent further states in column 2, starting in line 38, that "In addition the length of projection 16 is approximately equal to the spacing between point of intersection 21 and fold line 3." There is no requirement in the present invention to extend the slit 32 or 34 a distance into the side panel equal to the distance between the arcuate slit 72 and the fold line 16. Either distance can be more or less than the other depending on a number of design factors, including the caliper of the paperboard, the width of the handle opening, the height of the handle opening and the height it is desired to have the top panel of the carrier bow upwardly when the carrier is lifted.

The Wood patent further states in column 2, beginning in line 40, that "While the particular distance between point 21 and fold line 3 is not critical, it is preferable that this spacing be not less than twice the spacing between perforated slit 15 and fold line 17 in order to provide mechanical strength and to facilitate the function of handle flap 20." As stated above in connection with the first quotation from column 2 of Wood, this relationship is not essential in the present invention. This dimension can be varied and the handle will still perform satisfactorily due to the added stress relief afforded by the score lines 36, 38 and 44.

Figure 9:
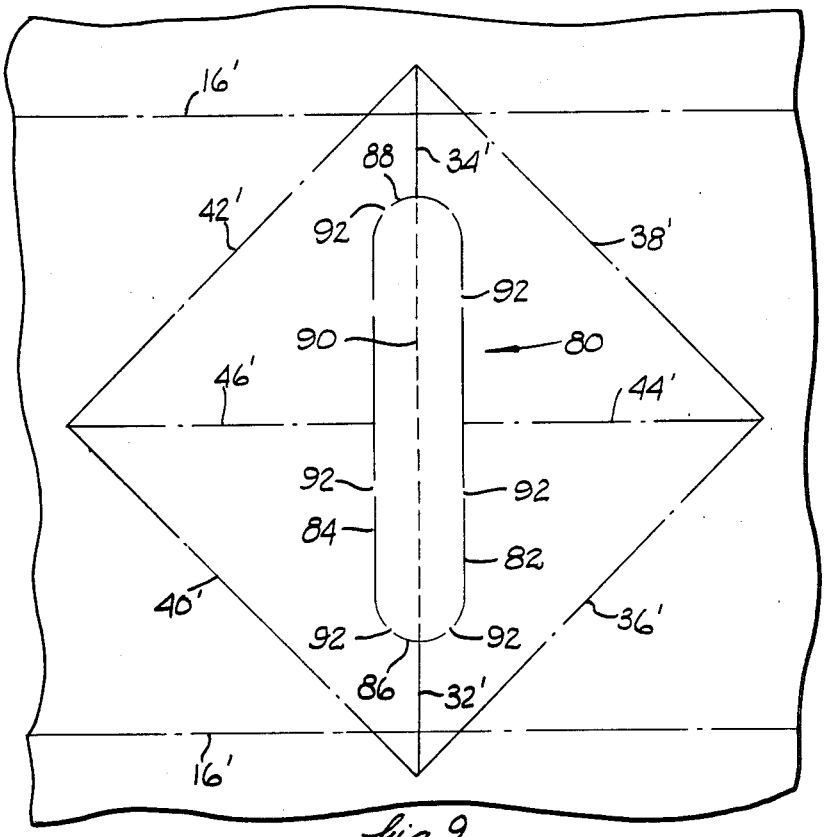
FIG. 9 is an enlarged partial plan view of a production blank incorporating a different tab embodiment.

Referring now to FIG. 9, a different handle flap embodiment is shown. In this arrangement the handle flap is located in the top panel in the same relationship to the stress relief score lines and slits as in the embodiment previously described. Thus the items denoted by prime reference numerals are the same as the items denoted by the related numerals in FIG. 2. In this design, however, the handle flap 80 comprises two elongated parallel cuts 82 and 84 which connect two arcuate cuts 86 and 88. A fold line 90 extends the length of the flap 80 and is aligned with the slits 32' and 34'. A number of relatively narrow segments of paperboard 92 have been retained so as to interrupt the slits 82, 84, 86 and 88 in order to hold the flap 80 in place until a user is ready to lift the carrier. In practice, depending on the width and number of the narrow connecting portions 92 and the manner in which the user punches the flap down, one of two things will occur. If the flap is pushed down aggressively, the connecting portions will be torn and the entire flap 80 will be separated from the top panel and deposited in the interior of the package. In that event the package is simply lifted in the normal manner without a double thickness of paperboard at the site of the fingers. The top panel will bow upwardly as in the main embodiment.

If all the connecting portions are not torn by pressure from the fingers, only the connecting portions adjacent the area of initial contact of the fingers will be torn and the flap 80 will be separated from the top panel at that point. For example, if the fingers initially strike the flap 80 adjacent the cut 84, the connecting portions 92 on that side of the flap will be torn and the flap separated there. The connecting portions along cut 82 would remain intact and would perform as hinges about which the flap 80 folds down. The flap 80, due to the presence of fold line 90, would then behave just as the flap 68 in the first embodiment, and would go through the same sequence of movements as shown in FIGS. 6–8. Thus the performance of the handle flap in this embodiment is the same regardless of the direction from which the fingers are inserted.

It should now be understood that the carrier of the present invention not only is more convenient to lift due to the location and arrangement of the single handle opening and the manner in which the top panel distorts to permit easy finger access into the opening, but is also more economical to produce. Whereas thicker stock is required to provide adequate strength in prior art sleeve-type carriers, thinner stock can be used to produce the carrier of this invention. For example, the handle of a carrier of the present invention formed of paperboard having a thickness of only 0.016 inch is comparable in strength to the suitcase type handle of a sleeve-type carrier formed of 0.021–0.023 inch paperboard. Further, these improvements can be provided merely by changing the design of the cutting and scoring die, an inexpensive measure which does not alter the overall dimensions of the blank or require any changes to be made in the standard blank forming or packaging machinery.

It should be understood that the use of the term "score line" herein refers to a rupturing of the surface of the blank sheet material, resulting a depression on one side of the sheet and a welt on the other, which allows the sheet to be folded on that line. It does not refer to a line which has been partially slit, which would weaken the fold.

It should also be obvious that although a preferred embodiment of the invention has been described, changes to certain specific details of the preferred embodiment can be made without departing from the spirit and scope of the invention.

What is claimed is:

1. A sleeve-type article carrier, comprising:
a top panel;
a bottom panel;
side panels integral with and foldably connected to the top and bottom panels; and
end panels between the top, bottom and side panels;
the top panel containing a handle opening comprising two elongated spaced edges extending transversely of the foldable connections between the side panels and the top panel, each of the elongated spaced edges having an end located relatively near one of the foldable connections and another end located relatively near the other foldable connection, the ends of the elongated spaced edges located relatively near each of the foldable connections being adjacent ends, the handle opening further comprising two short edges connecting the adjacent ends of the elongated edges;
the handle opening being covered by a tab of similar shape to that of the handle opening, the tab being connected to the top panel by a fold line along one of the elongated edges of the handle opening;
the tab containing a fold line intermediate of and generally parallel to the elongated edges thereof, whereby when the fingers of a person lifting the carrier press down against the tab, the tab is pivoted down along its fold line to expose the handle opening and when the pivoting movement is prevented due to contact with an adjacent article in the carrier, the tab folds upon itself about its intermediate fold line;
the top panel containing slits extending from the short edges of the handle opening transversely of and through the foldable connections between the side panels and the top panel, the slits ending in the side panels;
the side panels containing score lines extending from the ends of the transversely extending slits, across the foldable connections between the side panels and the top panel, and into the top panel, the score lines comprising a pair of score lines extending from the ends of the transversely extending slits and meeting in the top panel between the tab fold line and the nearest end panel.

2. A carrier according to claim 1, wherein the short edges of the handle opening are arcuate in shape.

3. A carrier according to claim 1, wherein the score lines comprise a second pair of score lines extending from the ends of the transversely extending slits and meeting in the top panel between the other elongated edge of the tab and the end panel nearest thereto.

4. A carrier according to claim 3, wherein the score lines extending from the end of each transversely extending slit form substantially equal but opposite angles with said slit.

5. A carrier according to claim 1, wherein the top panel contains an additional score line extending from the tab fold to the point at which the pair of score lines meet.

6. A carrier according to claim 5, wherein the additional score line extends substantially parallel to the foldable connections between the side panels and the top panel.

7. A carrier according to claim 6, wherein the additional score line meets the pair of score lines at a point located generally midway between the foldable connections between the side panels and the top panel.

8. A carrier according to claim 5, wherein the carrier is adapted to carry twelve beverage cans and the handle opening is located above the contacting sides of two adjacent interior cans in the carrier.

9. A sleeve-type carrier, comprising:
a top panel;
a bottom panel;
side panels integral with and foldably connected to the top and bottom panels; and
end panels between the top, bottom and side panels;
the top panel containing spaced edges extending transversely of the foldable connections between the side panels and the top panel, each of the elongated spaced edges having an end located relatively near one of the foldable connections and another end located relatively near the other foldable connection, the handle opening further comprising two short edges connecting the ends of the elongated spaced edges which are located relatively near each of the foldable connections;
the handle opening being covered by a tab of similar shape to that of the handle opening;
the tab being attached to the top panel along both of the elongated edges of the handle opening by connecting portions which can function as hinges when the fingers of a user press against the tab relatively gently or which can be broken when the fingers of a user press against the tab relatively hard;
the top panel containing slits extending from the short edges of the handle opening transversely of and through the foldable connections between the side panels and the top panel, the slits ending in the side panels;
the side panels containing score lines extending from the ends of the transversely extending slits to the foldable connections between the side panels and the top panel, the score lines comprising a first pair of score lines extending from the ends of the transversely extending slits and meeting in the top panel between one of the elongated edges of the handle opening and the nearest end panel, and a second pair of score lines extending from the ends of the transversely extending slits and meeting in the top panel between the other elongated edge of the handle opening and the end panel nearest thereto.

10. A carrier according to claim 9, wherein the top panel contains two additional score lines, one extending from one of the elongated edges of the handle opening to the point at which the first pair of score lines meet, and the other score line extending from the other elongated edge of the handle opening to the point at which the second pair of score lines meet.

11. A production blank adapted to be formed into a sleeve-type article carrier, comprising:
sheet material in the general shape of a rectangle;
the sheet having a central section intended to become the top panel of the carrier, end sections adapted to be connected together to form the bottom panel of the carrier, intermediate sections connected to the central and end sections by score lines and intended to become the side panels of the carrier, and flap sections connected to the intermediate sections by score lines and intended to become the end panels of the carrier;

the central section having a handle opening comprising two elongated spaced edges extending transversely of the score lines connecting the central section to the intermediate sections and two short edges connecting the elongated edges;

the handle opening being covered by a tab of similar shape to that of the handle opening, the tab being connected to the central section by a fold line along one of the elongated edges of the handle opening;

the tab containing a fold line intermediate of and generally parallel to the elongated edges thereof, whereby the tab can be pivoted down about its fold line by the fingers of a person lifting a carrier formed from the blank to expose the handle opening in the top panel of the carrier, the tab being adapted to fold upon itself about the intermediate fold line when the tab contacts an article and is thereby prevented from continued pivoting movement about the fold line;

the central section containing slits extending from the short edges of the handle opening transversely of and through the score lines connecting the central section to the intermediate sections, the slits ending in the intermediate sections;

the intermediate sections having score lines extending from the ends of the transversely extending slits, across the score lines connecting the central section to the intermediate sections, and into the central section, the score lines extending from the ends of the transversely extending slits comprising a pair of score lines meeting in the central section between the tab fold line and the nearest score line connecting the central section and a flap section.

12. A carrier production blank according to claim 11, wherein the score lines extending from the ends of the transversely extending slits comprise a second pair of score lines meeting in the central section between the other elongated edge of the tab and the nearest score line connecting the central section and a flap section.

13. A carrier production blank according to claim 12, wherein the score lines extending from the end of each transversely extending slit form substantially equal but opposite angles with the slit.

14. A carrier production blank according to claim 11, wherein the central section contains an additional score line extending from the tab fold line to the point at which the pair of score lines meet.

15. A carrier production blank according to claim 14, wherein the additional score line extends substantially parallel to the score lines connecting the central section to the intermediate sections.

16. A carrier production blank according to claim 15, wherein the additional score line meets the pair of score lines at a point located generally midway between the score lines connecting the intermediate sections to the central section.

17. A carrier production blank according to claim 11, wherein the two short edges of the handle opening are arcuate in shape.

18. (Amended) A sleeve-type article carrier, comprising:

a top panel;

a bottom panel;

side panels integral with and foldably connected to the top and bottom panels; and end panels between the top, bottom and side panels;

the top panel containing a handle opening comprising two elongated spaced edges extending transversely of the foldable connections between the side panels and the top panel and two short edges connecting the elongated edges;

the top panel containing slits extending from the short edges of the handle opening transversely of and through the foldable connections between the side panels and the top panel, the slits ending in the side panels;

the side panels containing score lines extending from the ends of the transversely extending slits, across the foldable connections between the side panels and the top panel and into the top panel, the score lines comprising a pair of score lines extending from the ends of the transversely extending slits and meeting in the top panel between one of the elongated edges of the handle opening and the nearest end panel.

19. A carrier according to claim 18, wherein the top panel contains an additional score line extending from one of the elongated edges of the handle opening to the point at which the pair of score lines meet.

20. A carrier according to claim 19, wherein the additional score line extends substantially parallel to the folds connecting the side panels to the top panel and meets the pair of score lines at a point located generally midway between the folds connecting the side panels to the top panel.

21. A carrier according to claim 18, wherein the score lines comprise a second pair of score lines extending from the ends of the transversely extending slits and meeting in the top panel between the other elongated edge of the handle opening and the end panel nearest thereto.

22. A carrier according to claim 21, wherein the score lines extending from the ends of the transversely extending slits form substantially equal but opposite angles with said slits.

23. A carrier according to claim 22, wherein the top panel contains additional score lines extending substantially parallel to the folds connecting the side panels to the top panel and connecting the elongated edges of the handle opening to the points at which the two pairs of score lines meet.

* * * * *